United States Patent [19]

Scheidt et al.

[11] Patent Number: 4,565,260

[45] Date of Patent: Jan. 21, 1986

[54] MECHANICAL LOCK JOINT FOR VEHICULAR EXHAUST SYSTEM MUFFLER AND THE LIKE

[75] Inventors: Wayne A. Scheidt, Wheaton, Ill.; Robert J. Paterick, Concord, Tenn.

[73] Assignee: Maremont Corporation, Chicago, Ill.

[21] Appl. No.: 656,946

[22] Filed: Oct. 2, 1984

[51] Int. Cl.[4] ..... F01N 7/18

[52] U.S. Cl. ..... 181/243; 181/255; 285/DIG. 22

[58] Field of Search ..... 181/243, 247-252, 181/255; 285/189, 192, 272, 382.2, 382.4, 382.5, DIG. 22; 138/161-168

[56] References Cited

U.S. PATENT DOCUMENTS

| | | | |
|---|---|---|---|
| 568,574 | 9/1896 | Hoyer | 285/382.5 X |
| 2,738,990 | 3/1956 | Hill | 285/192 X |
| 3,207,388 | 9/1965 | Waddington et al. | 285/DIG. 22 X |
| 4,333,672 | 6/1982 | Arthur et al. | 285/382.4 X |

*Primary Examiner*—Benjamin R. Fuller

*Attorney, Agent, or Firm*—Allegretti, Newitt, Witcoff & McAndrews, Ltd.

[57] ABSTRACT

In a vehicular exhaust system muffler, a mechanical tube and end panel joint. A bead extends about the tube. The bead is integral to the tube, annular, and radially outwardly extending. An annular flange extends along the tube and abuts the bead. The flange is integral to the end panel. A plurality of integral, interlocking protrusions are simultaneously deformed into the tube and flange. The bead, flange and protrusions totally mechanically join the tube and end panel.

6 Claims, 7 Drawing Figures

MECHANICAL LOCK JOINT FOR VEHICULAR EXHAUST SYSTEM MUFFLER AND THE LIKE

BACKGROUND OF THE INVENTION

This invention relates to vehicular exhaust system mufflers and the like, and more specifically, to the joints of internal components of the mufflers and like assemblies.

Spot welding is commonly used in the fabrication of vehicular exhaust system mufflers. As evidenced by U.S. Pat. Nos. 2,367,753; 3,557,903; and 3,608,667, spot welding has long been considered less than perfect as a jointing technique. A variety of reasons exist. First, spot welded joints may be difficult to inspect. Second, spot welding may adversely alter the internal structure of the jointed members within and adjacent the spot welded joints. Third, spot welding may interrupt the continuity of protective coatings on the jointed members. Fourth, joint member alignment may suffer due to material distortion during welding. Fifth, harmful metallic gases may be generated by spot welding, especially with galvanized materials. Sixth, time is required for spot welded joints to cool before further handling. For these and other reasons, quality control, speed and safety may not be achieved to an extent desired with spot welding. For these same reasons, mechanical joints have been attempted in the fabrication of vehicular exhaust system mufflers. Like welded joints, mechanical joints must provide acceptable, if not superior and excellent, tensile, compressive and torsional strengths between mated muffler components, as well as acceptable fatigue life and an acceptable seal against gas leakage. While the foregoing patents disclose such attempts, to date, superior mechanical joints have remained unachieved in muffler fabrication.

SUMMARY OF THE INVENTION

In a principal aspect, this invention is an improved, wholly mechanically joint in a vehicular exhaust system muffler. The muffler has a housing with a shell and end panels. Tubes extend through the end panels into the housing. The joint comprises, first, an integral, annular, radially outwardly extending bead on a tube. The end panel has a tube opening, defined by an integral, annular flange on the end panel. The flange extends along the tube outward of the tube from the bead. The tube extends through the opening within the flange. A plurality of integral, interlocking protrusions on the tube and flange complete the joint. The bead, flange and protrusions form a joint which is wholly mechanical, and superior in performance. The joint is also a seal against gas leakage.

These and other objects, aspects and advantages of the invention are more fully set forth in the detailed description of the preferred embodiment, which follows a brief description of the accompanying drawing.

DETAILED DESCRIPTION OF THE PREFERRED EMBODIMENT

Figure 1:
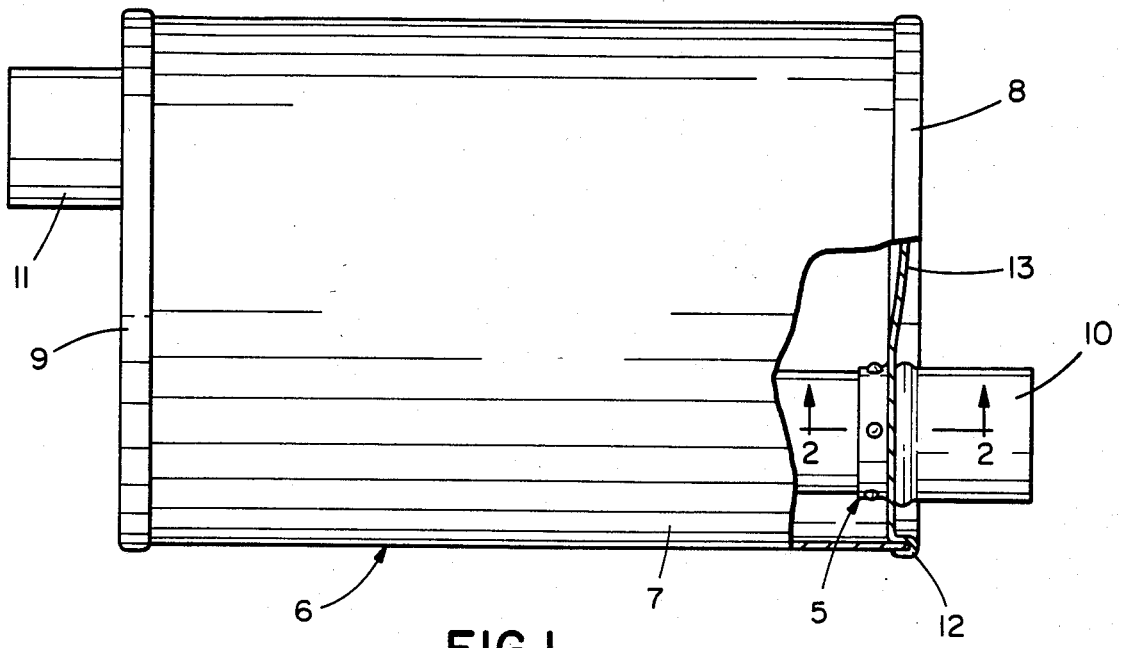
FIG. 1 is a view of a muffler with a portion broken away to reveal internal detail and the joint which is the preferred embodiment of the invention.

The preferred embodiment of the invention is a mechanical joint 5 in a muffler 6. A shell 7 of the muffler 6 is wrapped about and joined to two conical end panels 8, 9. A first tube 10 leads into the muffler 6 through the end panel 8, and a second tube 11 leads from the muffler 6 through the end panel 9. The tubes 10, 11 extend through internal panels (not shown) within the muffler 6, which divide the muffler interior into a plurality of chambers.

The first tube 10 is joined to the end panel 8 by the joint 5, and the second tube 11 is also joined to the end panel 9 by the joint 5 (not shown as to tube 11 and panel 9). Each tube 10, 11 is elongated, cylindrical, and of substantially uniform diameter throughout its length (except as described below).

With reference in the drawing to end panel 8 only, each end panel 8, 9 includes a rim 12 and a central portion 13. In the area of the joint 5, the portion 13 is substantially planar.

The portion 13 of the end panels 8, 9 includes a flange 14. The flange 14 is integral to the portion 13, annular, and defines the circular opening through the portion 13 for the tube. The flange 14 extends perpendicularly to the central portion 13, and axially along the tube into the interior of the muffler. The flange is external to the tube, and the inner diameter of the flange is equal to the outer diameter of the tube.

Figure 2:
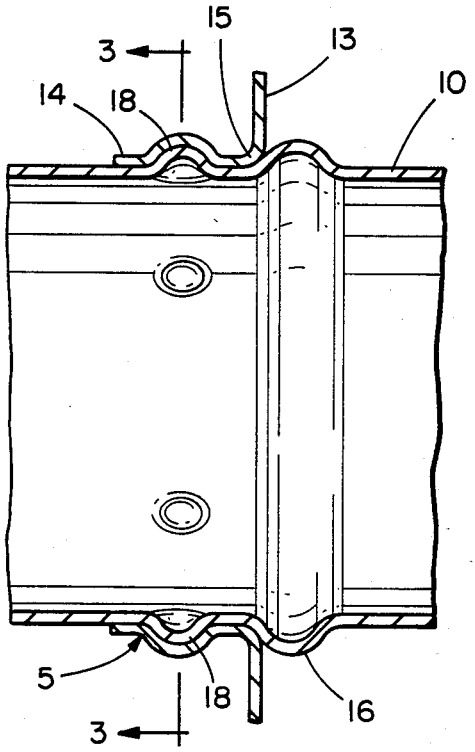
FIG. 2 is a cross-section view of the preferred embodiment taken along line 2—2 of FIG. 1.

The flange forms a right angle bend or shoulder 15 with the portion 13, in cross-section, as shown in FIG. 2. The shoulder abuts a bead 16 on the tube, and the flange extends from the bead 16.

The bead 16, in axial cross-section of the tube as in FIG. 2, is substantially semicircular, as shown in FIG. 2. The bead 16 is integral to the tube and is a ring or localized, annular, radially outwardly extending enlargement of the tube. The abutment of the shoulder and bead partially joins the flange and the tube against movement of the tube inward of the muffler relative to the panel.

Figure 3:
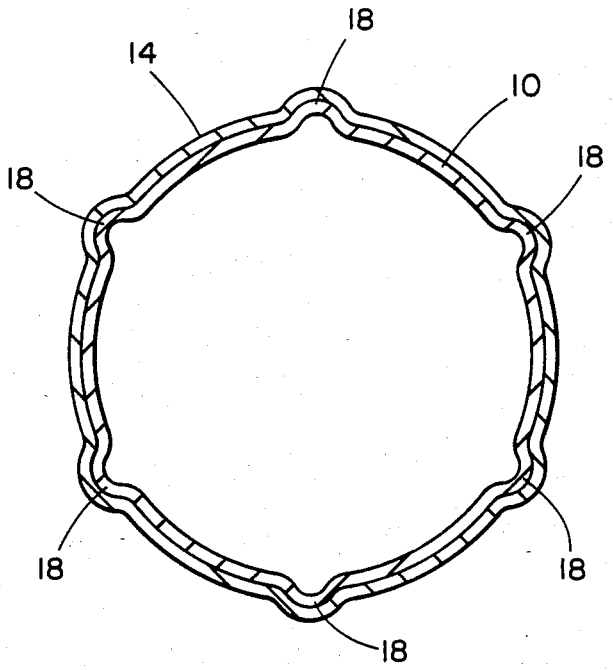
FIG. 3 is a cross-section view taken along line 3—3 of FIG. 2.

As shown best in FIG. 3, a plurality of protrusions 18 are formed in the flange and tube adjacent the shoulder and bead. The protrusions and the bead are formed simultaneously in the flange and tube, from with the tube. The protrusions and bead are formed by deformation of the flange and tube, through cooperation of an expanding, internal punch and an external die. The protrusions are circumferentially spaced about a single diameter of the flange and tube. Spacing is determined according to tooling requirements. In any cross-section, the protrusions are substantially semicircular, and thus, are substantially hemispherical overall. The protrusions protrude to the exterior of the flange and tube.

The radii of the flange interior surface and the tube exterior surface within the protrusions are substantially equal, and the centers of curvature are at the same point. The flange interior surface within the protrusions completely contacts the tube exterior surface. As a result, the protrusions are highly effective to fix the tube and flange relative to each other both axially and radially.

The joint 5 is now fully described. The joint 5 is not spot welded, and no other supplementary joining mechanism is included in the joint. The bead, flange and protrusions are the sole means of joining the tube and end panel. The joint 5 is totally mechanical. The bead, flange and protrusions cooperate to mechanically join the tube and panel in fixed axial and radial positions against tensile, compressive and torsional forces and pressures. The bead, flange and protrusions also effectively create a gas seal between the panel and tube.

The joint 5 has a variety of important advantages. The joint 5 can be quickly and easily formed. As soon as formed, the joint is effective, and need not be cooled or othewise set. No gases are created because no chemical reaction occurs. Protective coatings are not compromised. Material internal structure is not significantly altered, and the joint 5 is easy to inspect. Joint strength is superior.

While the joint 5 is most preferred, two alternate joints are also preferred. A first alternate joint 20 joins the same tube 10 and end panel central portion 13, as does a second alternate joint 30.

Figure 4:
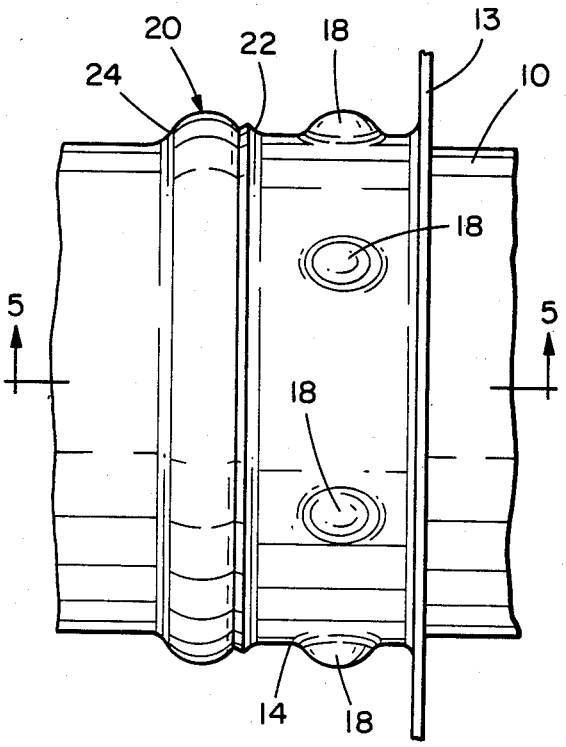
FIG. 4 is a detail view of a first alternate joint.
Figure 5:
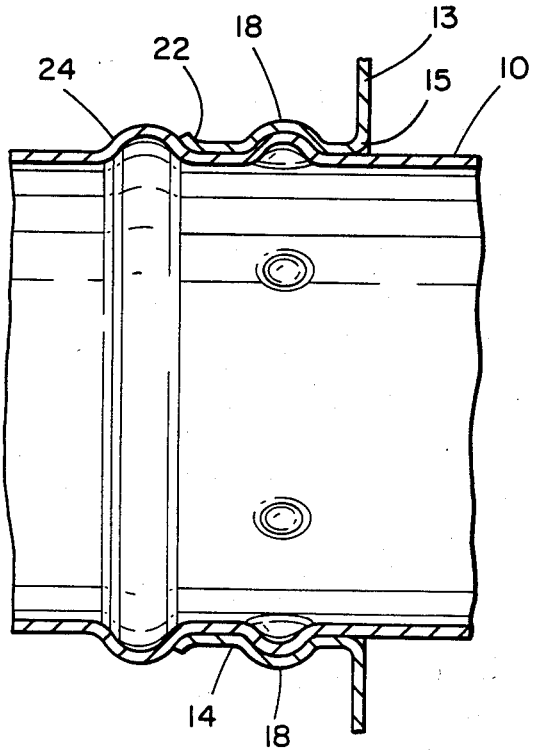
FIG. 5 is a cross-section view of the first alternate joint, taken along line 5—5 of FIG. 4.

Referring to FIGS. 4 and 5, the joint 20 includes the same protrusions 18 in the same location. The bead 16 is eliminated. The flange forms the shoulder 15, which in joint 20 is a first shoulder. A second shoulder 22 is formed in the flange 14 at its extreme end, remote from the end panel central portion 13.

The second shoulder 22 abuts a bead 24. The bead 24 is identical to the bead 16, but for location. The bead 24 is axially inward of the muffler from the end panel central portion 13, and adjacent the flange second shoulder 22.

The bead 24 and protrusions 18 are formed as are the bead 16 and protrusions 18.

Figure 6:
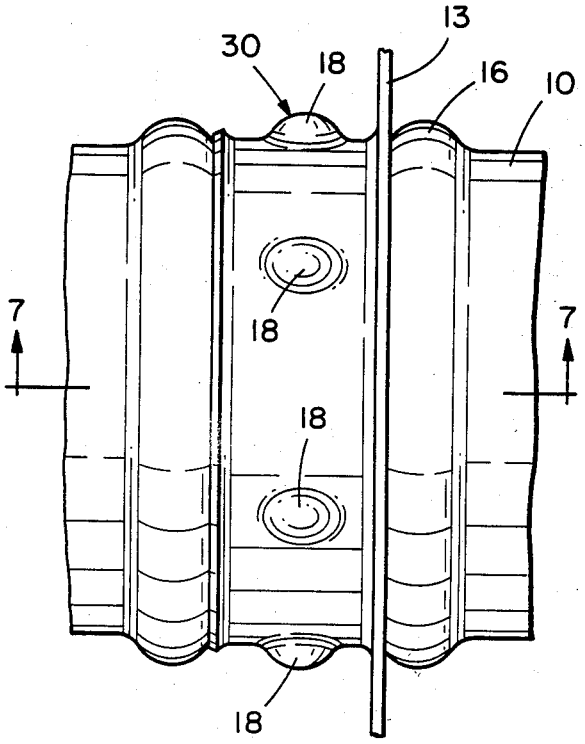
FIG. 6 is a detail view of a second alternate joint.
Figure 7:
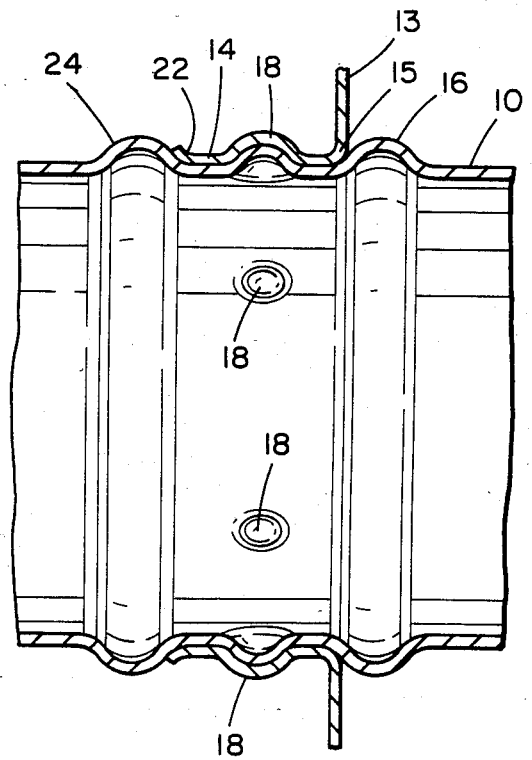
FIG. 7 is a cross-section view of the second alternate joint, taken along line 7—7 of FIG. 6.

Referring to FIGS. 6 and 7, the second alternate joint 30 combines the elements of the preferred joint 5 and first alternate joint 20. The flange 14 has shoulders 15, 22; the tube 10 has protrusions 18 and both beads 16, 24.

The preferred embodiment and two alternatives are now described. This preferred embodiment constitutes the best mode contemplated by the inventor of carrying out the invention. The invention, and the manner and process of making and using it, have been described in full, clear, concise and exact terms to enable any person skilled in the art to make and use the same. Because the invention may be copied without the copying of the precise details of the preferred embodiment, the following claims particularly point out and distinctly claim the subject matter which the inventor regards as his invention and wishes to protect.

What is claimed is:

1. In a vehicular exhaust system muffler having a housing with a shell and end panels, and tubes through the end panels into the housing, a mechanical tube and end panel joint comprising:

an integral, annular, radially outwardly extending bead on a first tube of said tubes, a tube opening in a first end panel of the end panels, an integral, annular flange of said first end panel adjacent the tube opening, the flange extending along the first tube radially outward of the first tube and adjacent the bead, the first tube extending through the opening within the first flange, a plurality of integral, interlocking protrusions on the first tube and first flange;

a shoulder formed by the flange with the panel, the shoulder abutting the bead.

2. In a vehicular exhaust system muffler having a housing with a panel and a tube, a panel and tube joint comprising:

a flange on the panel extending axially along the tube;

a plurality of integral, interlocking protrusions on the tube and flange;

an integral, annular, radially outwardly extending bead on the tube;

the flange on the panel extending axially along the tube from the bead, and being in contact with the bead; and a shoulder formed by the flange with the panel, the shoulder abutting the bead.

3. A panel and tube joint comprising:

a flange on the panel extending axially along the tube;

a plurality of integral, interlocking protrusions on the tube and flange;

an integral, annular, radially outwardly extending bead on the tube;

the flange on the panel extending axially along the tube from the bead, and being in contact with the bead; and a shoulder formed by the flange with the panel, the shoulder abutting the bead.

4. A joint as in claim 1 or 2 or 3 in which the protrusions are substantially hemispherical.

5. A joint as in claim 1 or 2 or 3 in whch the bead, flange and protrusions constitute means for mechanically joining the panel and tube in fixed axial and radial positions against tensile, compressive and torsional forces and pressures.

6. A joint as in claim 1 or 2 or 3 in which the bead, flange and protrusions constitute means for gas sealing the panel to the tube.

* * * * *